US006123629A

United States Patent [19]

Yamaguchi et al.

[11] Patent Number: 6,123,629

[45] Date of Patent: Sep. 26, 2000

[54] METHOD OF MAKING A GOLF BALL WITH IMPROVED FLIGHT DISTANCE AND SHOT FEELING

[75] Inventors: Tetsuo Yamaguchi, Nishinomiya; Kazunari Yoshida, Kasai; Takahiro Sajima, Izumi, all of Japan

[73] Assignee: Sumitomo Rubber Industries Limited, Kobe, Japan

[21] Appl. No.: 09/123,581

[22] Filed: Jul. 28, 1998

[30] Foreign Application Priority Data

Sep. 2, 1997 [JP] Japan ..... 9-237440

[51] Int. Cl.[7] ..... A63B 37/04

[52] U.S. Cl. ..... 473/372; 473/377

[58] Field of Search ..... 473/372, 377

[56] References Cited

U.S. PATENT DOCUMENTS 3,784,209 1/1974 Berman et al. ..... 473/377
4,141,559 2/1979 Melvin et al. ..... 473/372
4,928,965 5/1990 Yamaguchi et al. ..... 273/78
5,803,831 9/1998 Sullivan et al. ..... 473/377 X
5,803,832 9/1998 Nakamura et al. ..... 473/377
5,820,489 10/1998 Sullivan et al. ..... 473/377
5,857,925 1/1999 Sullivan et al. ..... 473/377 X
5,919,101 7/1999 Yokota et al. ..... 473/377 X

*Primary Examiner*—Jeanette Chapman
*Assistant Examiner*—Raeann Gorden
*Attorney, Agent, or Firm*—Birch, Stewart, Kolasch, & Birch, LLP

[57] ABSTRACT

A golf ball includes a core and a cover which covers the core, wherein a ratio between the primary natural frequency ($CF_1$) of the core and the primary natural frequency ($BF_1$) of the golf ball satisfies a following mathematical relation:

$$0.30 \leqq CF_1/BF_1 \leqq 0.78$$

13 Claims, 2 Drawing Sheets

METHOD OF MAKING A GOLF BALL WITH IMPROVED FLIGHT DISTANCE AND SHOT FEELING

FIELD OF THE INVENTION

The present invention relates to a solid golf ball which gives a good balance between flight distance and shot feeling as well as good hit sound when hit.

BACKGROUND OF THE INVENTION

It is known that the flight distance of golf ball is greatly influenced by the relationship between the primary natural frequency ($BF_1$) of a golf ball and the primary natural frequency ($KF_1$) of a club head. In general, the closer the primary natural frequency ($BF_1$) of a ball and the primary natural frequency ($KF_1$) of a club head are to each other, the better the matching of the mechanical impedance therebetween becomes when the golf ball is hit with the golf club. This produces large impact resilience, which results in a long flight distance. Commercially available golf balls have a primary natural frequency of about 600 to 1600 Hz. Golf clubs with a club head made of persimmon, which are typical wood-type golf clubs, have a primary natural frequency of about 1800 to 2800 Hz. In order to produce a longer flight distance, one considers reducing the primary natural frequency of a golf club or increasing the primary natural frequency of a golf ball. The term "primary natural frequency" indicates a frequency measured when the mechanical impedance takes a primary minimum value.

Recently, golf clubs with a head made of stainless steel and titanium alloy, which produce long flight distance, have been mainly used as wood-type golf clubs. The golf club with a stainless steel head has a primary natural frequency ($KF_1$) of about 1800 to 2500 Hz, and the golf club with a titanium alloy head has a primary natural frequency ($KF_1$) of about 1400 to 1600 Hz. Both of these values are smaller than the primary natural frequency ($KF_1$) of golf clubs with a head made of persimmon. The primary natural frequency ($KF_1$) of the golf club is proportional to the spring constant thereof. Therefore, when the spring constant of the club head is lowered, the primary natural frequency ($KF_1$) thereof is also lowered. As methods for reducing the spring constant of the club head, one conceives using a club head having a face with a thin thickness, or using a club head made of a material having small modulus of elasticity. However, such methods generally lower the strength and the hardness of the club head, and as a result, the durability and the resistance to flaw of the club head are deteriorated. Under such a situation, a limitation on reducing the primary natural frequency ($KF_1$) of the club head to a value close to the primary natural frequency ($BF_1$) of the golf ball is present. At present, the titanium alloy club head is considered to have the lowest possible primary natural frequency ($KF_1$).

Due to such a problem, in an actual operation, the primary natural frequency ($BF_1$) of a golf ball is increased so as to be close to that of the titanium alloy club head. However, when the primary natural frequency ($BF_1$) of a golf ball is increased, its hardness is also increased. In this case, the golf ball produces a long flight distance and, the impact when hitting the ball becomes larger. It has been conventionally said that, although the commercially available golf balls having the primary natural frequency ($BF_1$) of 1000 Hz or higher produce a long flight distance, they give the golf players the large impact when hit (i.e., they give golf players the feeling of hitting a hard golf ball).

In addition, it is also important to keep a good hit sound hit. A low hit sound gives the golf player an impression that the flight distance is short, regardless of whether or not the actual flight distance is long.

SUMMARY OF THE INVENTION

The present invention has been conducted to solve the above-described problems, and an object thereof is to provide a golf ball capable of producing a good shot feeling and a long flight distance, as well as capable of producing a preferable hit sound which gives an impression to a golf player that the flight distance is long.

According to one aspect of the present invention, a golf ball includes a core and a cover, which covers the core, wherein a ratio between the primary natural frequency ($CF_1$) of the core and the primary natural frequency ($BF_1$) of the golf ball satisfies a following mathematical relation:

$$0.30 \leqq CF_1/BF_1 \leqq 0.78$$

These and other objects, features, aspects and advantages of the present invention will become more apparent from the following detailed description of the present invention when taken in conjunction with the accompanying drawings.

DETAILED DESCRIPTION OF THE PREFERRED EMBODIMENTS OF THE INVENTION

Figure 1:
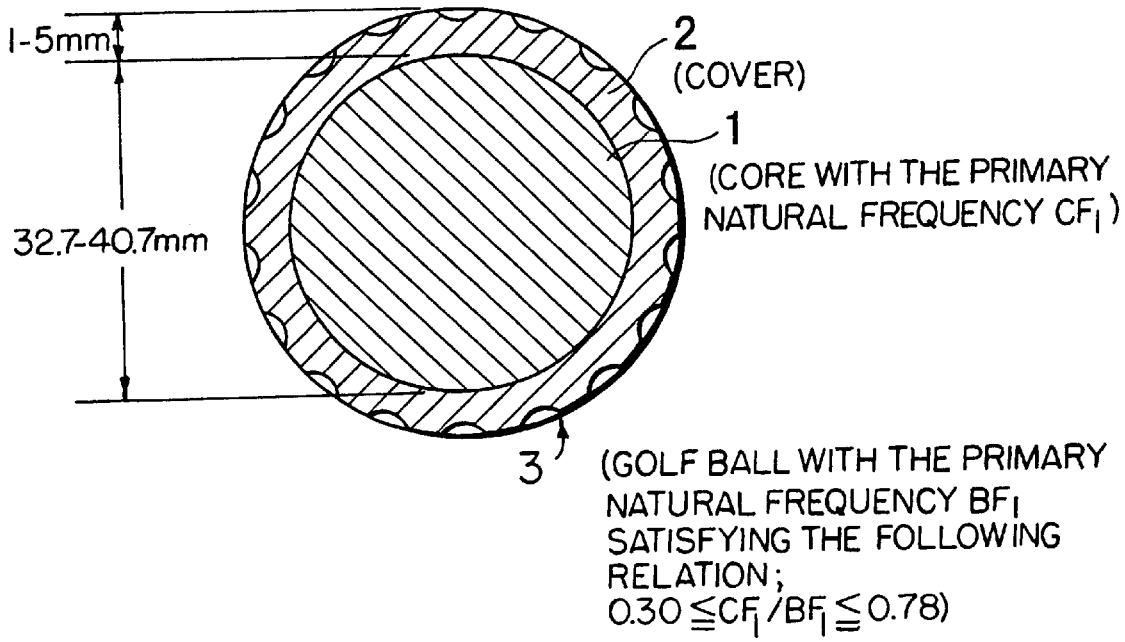
FIG. 1 is a diagram showing a golf ball including a core and a cover according to the present invention.

FIG. 1 is a diagram showing a golf ball according to the present invention. The golf ball is a solid golf ball including a core 1 and a cover 2 which covers the core. The core 1 may be in a single layered structure or may be in a multilayered structure having two or more layers. Similarly, the cover 2 may be in a single layered structure or may be in a multilayered structure having two or more layers.

When the golf ball includes a single-layered core, the primary natural frequency ($CF_1$) of the core indicates the primary natural frequency of the single core. When the golf ball includes a multilayered core having two or more layers, the primary natural frequency ($CF_1$) of the core indicates the primary natural frequency of the entire core including two or more layers. The primary natural frequency ($BF_1$) of the golf ball indicates the primary natural frequency of the entire golf ball 3.

Figure 2:
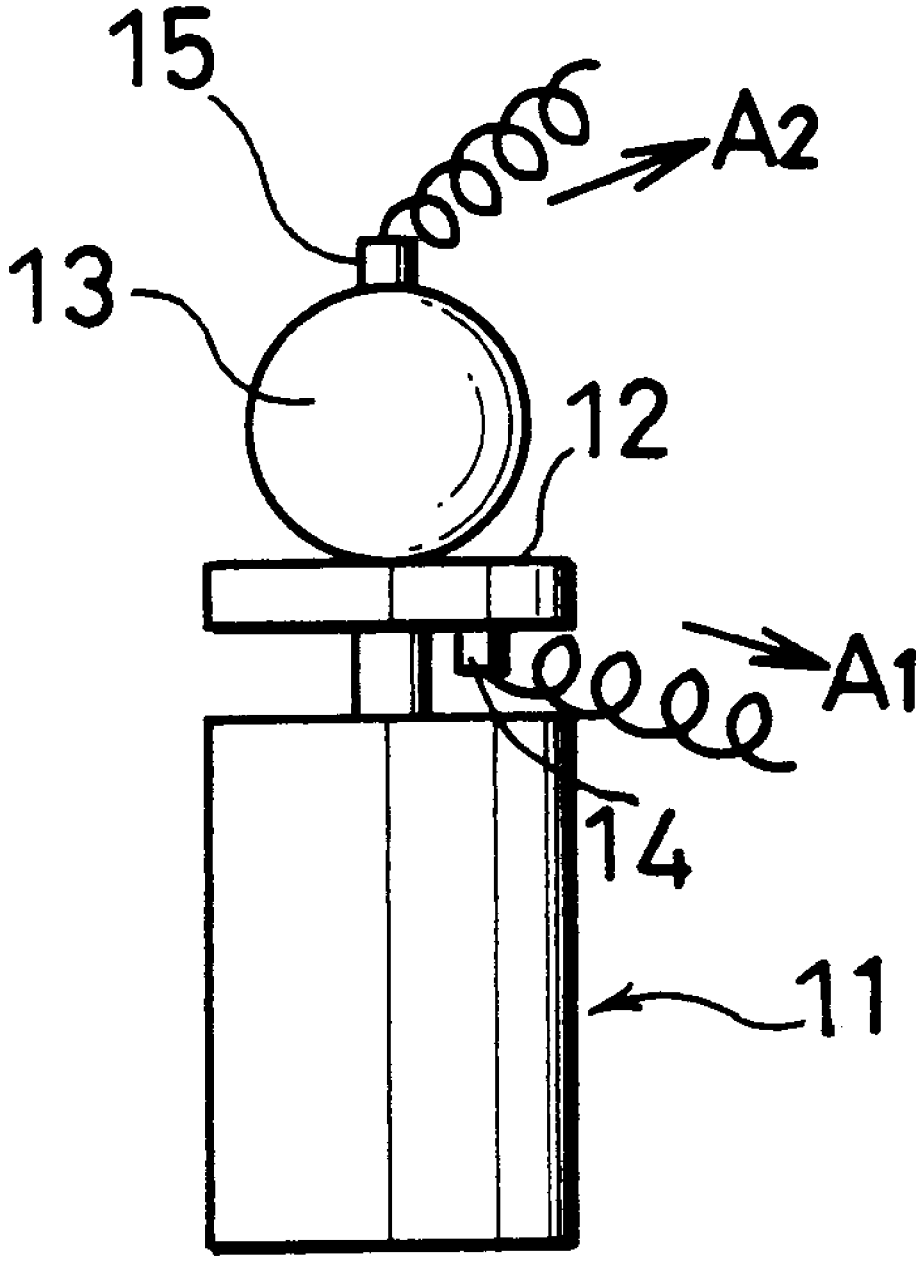
FIG. 2 is a diagram showing a vibrator used for measuring the natural frequencies according to the present invention.

The natural frequency is a frequency measured when the mechanical impedance takes a minimum value. The natural frequency is measured by giving a vibration to a core or a golf ball using a vibrator (for example, PET, a product of Kabushiki Kaisha Kokusai Kikai Shindo Kenkyusho). FIG. 2 is a diagram showing a vibrator 11 used for measuring the natural frequencies in the present invention. In the vibrator 11, a sample 13 (a golf ball or a solid core) is placed onto a sample holding table 12. A first acceleration pickup 14 is firmly adhered to the sample holding table 12, and a second acceleration pickup 15 is firmly adhered to the sample 13. When the sample 13 is vibrated by the vibrator 11, the acceleration speed A1 applied to the sample 13 is output from the first acceleration pickup 14, and the acceleration speed A2 applied to the sample 13 is output from the second acceleration pickup 15. These outputs are input into a dynamic single analyzer (for example, HP-5420A, a product of Yokogawa-Hewlett-Packard, Ltd.), where the outputs are subjected to calculation to obtain the relationship between the frequency and the mechanical impedance of the sample 13 which can be expressed by a frequency characteristic curve. In the frequency characteristic curve, the frequency at which the mechanical impedance of the sample takes a minimum value is the natural frequency of the sample. The primary natural frequency is a frequency measured when the mechanical impedance which appears in the frequency characteristic curve takes a primary minimum value, and the secondary natural frequency is a secondary minimum value of the mechanical impedance which appears in the frequency characteristic curve.

According to the present invention, the ratio of the primary natural frequency ($CF_1$) of the core to the primary natural frequency ($BF_1$) of the entire golf ball is 0.30 to 0.78. That is, the ratio satisfies the relationship of $0.30 \leqq CF_1/BF_1 \leqq 0.78$. Preferably, the lower limit of the ratio is 0.4 and the upper limit of the ratio is 0.75, and more preferably, the lower limit of the ratio is 0.5 and the upper limit of the ratio is 0.70. The kinds of the core and the cover are not specifically limited as far as these conditions are satisfied.

Therefore, the core may be made of a composition containing crosslinked rubber (including vulcanized rubber), elastomer, ionomer, or the mixture thereof which satisfies the above-described conditions, and the blending ratio is not specifically limited. Preferably, the blending ratio is controlled so that the core has a primary natural frequency ($CF_1$) of about 350 to 900 Hz, more preferably about 400 to 850 Hz. Furthermore, the core preferably has a secondary natural frequency ($CF_2$) (i.e., the frequency of the secondary minimum value of the mechanical impedance) of 850 Hz or more, and more preferably 900 Hz or more. When the secondary natural frequency ($CF_2$) is less than 850 Hz, the golf ball produces very low hit sound when hit (hereinafter, referred to as a hit sound). This gives a golf player an impression that the flight distance is short. The upper limit of the secondary natural frequency ($CF_2$) of the entire core is less than 2700 Hz, and more preferably less than 2500 Hz, and the most preferably less than 2400 Hz. When the secondary natural frequency ($CF_2$) exceeds 2700 Hz, the golf ball produces very high hit sound like a metallic sound. This gives golf players the feeling of hitting a hard golf ball.

The core is preferably made of a rubber composition which includes a base rubber containing 80 weight percent or more, and preferably 90 weight percent or more of polybutadiene rubber having 80 percent or more, and preferably 90 percent or more, and the most preferably 95 percent or more of cis-1,4-bond. In the present invention, such a polybutadiene rubber is referred to as a "high cis-polybutadiene rubber", and is distinguished from a normal polybutadiene rubber. The base rubber may include: diene based rubber components other than high cis-polybutadiene rubber such as natural rubber, polyisoprene rubber, styrenepolybutadiene rubber, and EPDM; rubber components other than diene based rubber; and polymers other than rubber such as elastomer and ionomer, as far as the content thereof is less than 20 weight percent, and preferably less than 10 weight percent of the base rubber. The primary natural frequency ($CF_1$) of the core increases as the base rubber contains larger amount of high cis-polybutadiene rubber. In addition, the primary natural frequency ($CF_1$) of the core increases as the base rubber includes larger amount of polymer components other than rubber components.

In order to crosslink the rubber, the rubber composition may be blended with a compound such as: a mixture of an organic peroxide and a metal of unsaturated carboxylic acid; sulfur; and sulfur-based compounds. Among them, the mixture of an organic peroxide as a crosslinking agent and metal salt of an unsaturated carboxylic acid as a co-crosslinking agent is preferable.

Examples of organic peroxides include dicumyl peroxide and t-butyl peroxide. Among them, dicumyl peroxide is preferable. The preferable content of the organic peroxide is 0.5 to 3.0 parts by weight with respect to 100 parts by weight of the base rubber. When the content of the organic peroxide is less than 0.5 parts by weight, the hardness of the core becomes too low (that is, the core becomes too soft), and as a result, the primary natural frequency ($CF_1$) of the core becomes too low. This impairs the impact resilience of the golf ball which in turn causes poor flight distance. Contrary to this, when the content of the organic peroxide is larger than 3.0 parts by weight, the hardness of the core becomes too high (that is, the core becomes too hard), and as a result, the primary natural frequency ($CF_1$) of the core becomes too high. This produces an excessively large shot impact when the ball is hit.

Examples of the metal salt of the unsaturated carboxylic acid include monovalent and bivalent metal salts such as zinc α,β-unsaturated carboxylate having 3 to 8 carbon atoms such as zinc acrylate and zinc methacrylate, and magnesium α,β-unsaturated carboxylate. Among them, preferable is zinc acrylate which gives high resilience without excessively increasing the primary natural frequency ($CF_1$) of the core. As the larger amount of the metal salt of the unsaturated carboxylic acid is contained, the hardness of the core becomes higher, and as a result, the primary natural frequency ($CF_1$) of the core becomes higher. In order to satisfy the requirements of the present invention, it is preferable that 25 to 45 parts by weight, and more preferably 25 to 35 parts by weight of the metal salt of unsaturated carboxylic acid is added with respect to 100 parts by weight of the base rubber. When the content of the metal salt of unsaturated carboxylic acid is larger than 45 parts by weight, the hardness of the core becomes too high, and as a result, the primary natural frequency ($CF_1$) of the core becomes too high. This produces an excessively large shot impact when the ball is hit. Contrary to this, when the content of the metal salt is unsaturated carboxylic acid of less than 25 parts by weight, the hardness of the core becomes too low, and as a result, the primary natural frequency ($CF_1$) of the core becomes too low. This impairs the impact resilience of the golf ball which in turn causes poor flight distance.

If necessary, the rubber component is blended with a filler for increasing a specific gravity or a filler for decreasing a specific gravity. When the filler for decreasing a specific gravity is blended, the core is lighter weight, and as a result, its primary natural frequency ($CF_1$) becomes high. Specific examples of the filler for decreasing a specific gravity include zinc oxide, barium sulfide, and calcium carbonate. Among them, zinc oxide is preferable. When the filler for increasing a specific gravity is blended, the core is heavier weight, and as a result, its primary natural frequency ($CF_1$) becomes low. Used as the filler for increasing a specific gravity are metal powder, metal oxides, metal nitrides having a specific gravity of 8 to 20, or a mixture thereof. Specific examples thereof include tungsten (specific gravity: 19.3), tungsten carbide (specific gravity: 15.8), molybdenum (specific gravity: 10.2), lead (specific gravity: 11.3), lead oxide (specific gravity: 19.3), nickel (specific gravity: 8.9), copper (specific gravity: 8.9), and a mixture thereof. It is also possible to use a mixture of the filler for increasing a specific gravity and the filler for decreasing a specific gravity.

The above-described compounds are blended with each other to produce a rubber composition, and the rubber composition is kneaded with roller or kneader. The resultant composition is heated, compressed and/or vulcanized in a mold to produce a core.

The diameter of the entire golf ball is defined as 1.68 inches (42.67 mm) or larger in the R&A standard. As most commercially available golf balls have a diameter of 1.680 (42.67 mm) to 1.686 inches (42.82 mm), the preferable diameter of the core is 32.7 to 40.7 mm. When the core is a multilayered core having two or more layers, the thickness of each layer is not specifically limited as far as the diameter of the entire core falls within the range between 32.7 and 40.7 mm.

The primary natural frequency ($CF_1$) and the secondary natural frequency ($CF_2$) of the core can be changed not only by changing the blending ratio of the rubber composition but also by changing the production conditions. Under the production conditions where the kneading time, Mooney viscosity, the time and temperature for the reaction such as crosslinking (including vulcanizing) are adjusted so as to produce a core with high hardness, the core has high primary natural frequency ($CF_1$).

A cover may be made of a known composition used for producing a cover. Specific examples of the composition include ionomer, balata, polyurethane resins, thermoplastic elastomer, fiber reinforced resins, and metal powder blended resins. Among them, preferable is ionomer or a mixture of ionomer and other thermoplastic resins. As the cover composition includes larger amount of ionomer, the hardness of the cover becomes higher. This results in increasing the primary natural frequency ($BF_1$) of the entire golf ball.

The ionomer is a copolymer of ethylene and (meth)acrylic acid in which a part of carboxylic acid is neutralized with a metal ion, or a mixture thereof. Used as the metal ions include: alkaline metal ions such as sodium ions, potassium ions, and lithium ions; bivalent metal ions such as zinc ions, calcium ions, and magnesium ions; and trivalent metal ions such as aluminum ions and neodymium ions. Specific examples thereof include Himilan (a product of Mitsui DuPont Polychemical Co.) and IOTEC (a product of Exon Co., Ltd.). The balata is selected from natural balata, synthesized balata, and a mixture thereof. The synthesized balata is transpolyisoprene which is commercially available under the name of TP301 (a product of Clareisopurene Co., Ltd.).

If necessary, the cover composition may further include fillers such as a coloring agent (for example, titanium dioxide), an ultraviolet absorber, a light stabilizer, and a fluorescent whitening agent as far as the requirements of the present invention are satisfied.

The composition and the thickness of the cover are adjusted so that the primary natural frequency ($BF_1$) of the entire golf ball falls within the range between 550 and 1700 Hz, and preferably between 600 and 1600 Hz. Preferably, the thickness of the cover is 1 to 5 mm.

The golf ball of the present invention can be produced by conventionally known methods. For example, a core is produced by press-molding, and the core is covered with cover composition by injection molding. Or alternatively, a core is covered with a pair of half-cup shaped covers, and in this state, the core and the covers are heated to be formed into one piece golf ball.

EXAMPLES

Production of Sample Golf Ball

Sample golf balls Nos. 1 to 15 were produced as follows.

A rubber composition for the core was prepared by blending a mixture of high cis-polybutadiene and natural rubber as a base rubber, and fillers such as organic peroxide (DCP) as a crosslinking agent and zinc acrlylate as a co-crosslinking agent. The rubber composition was formed to a single-layered core having a diameter of 37.5 mm.

A resin composition for the cover was prepared by blending 100 parts by weight of a mixture of Himilan No. 1605 and Himilan No. 1706 (ionomers, products of Mitsui DuPont Polychemical Co.), and 2 parts by weight of titanium dioxide.

The core was set in a mold for injection molding, and was covered with the cover composition by injection molding to form a cover having a thickness of 2.6 mm. As a result, a sample golf ball having a diameter of 42.7 mm was obtained.

As shown in Table 1, in producing the sample golf balls Nos. 1 to 15, the cores were produced by changing the amount of organic peroxide and/or a co-crosslinking agent, high cis-polybutadiene rubber, and natural rubber. In addition, the covers were produced by changing the amount of Himilan Nos. 1605 and 1706. As a result, the sample golf balls Nos. 1 to 15 had various primary natural frequencies ($CF_1$) of the core and various primary natural frequencies ($BF_1$) of the golf ball. The sample golf balls 2, 12, and 15 were produced to have the same constitution as commercially available golf balls, and therefore, corresponded to the prior art.

TABLE 1

| No. | | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| Composition of core | High cis-polybutadiene rubber | 100 | 90 | 90 | 100 | 95 | 100 | 100 | 100 | 100 | 100 | 95 | 90 | 90 | 90 | 90 |
| | Natural rubber | 0 | 10 | 10 | 0 | 5 | 0 | 0 | 0 | 0 | 0 | 5 | 10 | 10 | 10 | 10 |
| | Co-crosslinking agent | 27 | 27 | 23 | 27 | 30 | 27 | 28 | 28 | 30 | 32 | 33 | 34 | 37 | 34 | 43 |
| | DCP | 2.0 | 1.5 | 2.0 | 1.5 | 1.5 | 2.0 | 1.5 | 2.0 | 2.0 | 1.5 | 2.0 | 2.0 | 1.5 | 2.0 | 1.0 |
| Composition of cover | Himilan 1605 | 30 | 30 | 80 | 50 | 50 | 50 | 50 | 50 | 50 | 50 | 50 | 50 | 50 | 75 | 50 |
| | Himilan 1706 | 70 | 70 | 20 | 50 | 50 | 50 | 50 | 50 | 50 | 50 | 50 | 50 | 50 | 25 | 50 |
| | Titanium dioxide | 2 | 2 | 2 | 2 | 2 | 2 | 2 | 2 | 2 | 2 | 2 | 2 | 2 | 2 | 2 |
| | | Ex | Conv | Comp | Ex | Ex | Ex | Ex | Ex | Ex | Ex | Comp | Conv | Comp | Ex | Conv |

Method for Evaluation

1. Flight Distance

The sample golf ball No. 1 was hit by a wood-type golf club attached to a swing robot (a product of True Temper Co., Ltd.) at the head speed of 45 m/sec, and the distance from the hit point to the point of fall was measured. The sample golf ball No. 1 was hit five times, and the average flight distance of three hits except for the maximum and minimum flight distances was obtained. Thus-obtained average flight distance was assumed to be the flight distance of the sample golf ball No. 1. Defining the flight distance of the sample golf ball No. 12 which corresponded to the prior art as 100, the flight distances of the sample golf ball No. 1 was compared with that of the sample No. 12, and was expressed by an index.

Repeating these steps, the flight distance of the sample golf balls Nos. 2 to 15 was evaluated and expressed by an index.

The results are shown in Table 2. In Table 2, as larger the index is, the longer the flight distance is.

The wood-type golf club had a titanium alloy head, of which primary natural frequency ($KF_1$) was 1500 Hz.

2. Impact

The sample golf ball No. 1 was hit by ten golfers. Defining the smallest impact as 10 points which was the perfect value, and the impact when hit the sample golf ball No. 12 as 5 points, the impact of the sample golf ball No. 1 felt by them was expressed by a score. The scores of ten golfers was averaged, and the average value was assumed to be the impact of the sample golf ball No. 1.

Repeating these steps, the impact of the sample golf balls Nos. 2 to 15 was evaluated and expressed by a score.

The results are shown in Table 2.

3. Hit Sound

The sample golf ball No. 1 was hit by ten persons. Defining the best hit sound as 10 points which was the perfect value, and the hit sound when hit the sample golf ball No. 12 as 5 points, the hit sound of the sample golf ball No. 1 heard by them was expressed by a score. The scores of ten persons was averaged, and the average value was assumed to be the hit sound of the sample golf ball No. 1.

Repeating these steps, the hit sound of the sample golf balls Nos. 2 to 15 was evaluated and expressed by points.

The test results are shown in Table 2.

TABLE 2

| No. | | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| Golf ball | $BF_1$ | 600 | 600 | 1000 | 1000 | 1000 | 1000 | 1000 | 1000 | 1000 | 1000 | 1000 | 1000 | 1000 | 1600 | 1600 |
| | $CF_1$ | 400 | 500 | 250 | 400 | 400 | 400 | 500 | 650 | 700 | 750 | 800 | 850 | 850 | 850 | 1300 |
| | $CF_2$ | 1200 | 1550 | 800 | 800 | 900 | 1200 | 1550 | 1950 | 2050 | 2200 | 2400 | 2500 | 2800 | 2500 | 3250 |
| | $CF_1/BF_1$ | 0.67 | 0.83 | 0.25 | 0.40 | 0.40 | 0.40 | 0.50 | 0.65 | 0.70 | 0.75 | 0.80 | 0.85 | 0.85 | 0.53 | 0.81 |
| Characteristics | Flight distance | 95 | 95 | 95 | 99 | 99 | 99 | 100 | 100 | 100 | 100 | 100 | 100 | 100 | 104 | 104 |
| | Impact | 9.9 | 8.8 | 8.5 | 8.6 | 8.5 | 8.5 | 8.2 | 7.4 | 7.1 | 6.6 | 5.1 | 5.0 | 4.9 | 5.0 | 2.3 |
| | Impact sound impression | 6.6 | 6.1 | 4.5 | 4.7 | 5.5 | 6.2 | 6.2 | 5.9 | 5.8 | 5.6 | 5.3 | 5.0 | 3.9 | 4.9 | 3.2 |
| | | Ex | Conv | Comp | Ex | Ex | Ex | Ex | Ex | Ex | Ex | Comp | Conv | Comp | Ex | Conv |

As seen in the comparison of the sample golf balls Nos. 1 and 2, the primary natural frequency ($BF_1$) of the golf ball was the same each other, and the primary natural frequency ($CF_1$) of the core was different from each other. The same can be said as to the comparison of the sample golf balls Nos. 3 to 13, and Nos. 14 and 15, respectively. From the evaluation result, it is understood that the differences in the natural frequency ($CF_1$) of the core caused the difference in the flight distance, the impact, and the hit sound, even if the natural frequency ($BF_1$) of the golf ball is the same each other. Contrary to this, as seen in the comparison of the sample golf balls Nos. 1 and 6, the primary natural frequency ($CF_1$) of the core is the same each other, and the primary natural frequency ($BF_1$) of the entire golf ball is different from each other. The same can be said to the comparison of the sample golf balls Nos. 2 and 7, and Nos. 12 and 14, respectively. From the evaluation result, it is understood that the difference in the primary natural frequency ($BF_1$) of the golf ball caused the differences in the flight distance and the impact, even if the primary natural frequency ($CF_1$) of the core is the same each other.

From these results, it is understood that the balance between the primary natural frequency ($CF_1$) of the core and in the primary natural frequency ($BF_1$) of the entire golf ball is important.

Furthermore, as seen in the comparison of the sample golf balls Nos. 3 to 13, the higher the primary natural frequency ($CF_1$) of the core, the larger the value of $CF_1/BF_1$ becomes when the primary natural frequency ($BF_1$) of the entire golf ball was the same each other. In this case, however, the impact and the hit sound were deteriorated, although the flight distance became longer. When the value of $CF_1/BF_1$ exceeded 0.5, the effect of improving flight distance was saturated and no longer flight distance could not be expected any more, as seen in the evaluation results of the sample golf balls Nos. 7 to 13. As a consequence, it is understood that, when the relationship of $0.3 \leqq CF_1/BF_1 \leqq 0.78$ is satisfied, the golf ball produces the excellent impact and the good hit sound as well as producing a long flight distance.

In addition, as seen in the comparison of the sample golf balls Nos. 4 to 6, the secondary natural frequency ($CF_2$) of the core was different from each other, and the natural primary frequency ($BF_1$) of the entire golf ball and the natural primary frequency ($CF_1$) of the core respectively were the same each other. The same can be said in comparison of the sample golf balls Nos. 12 and 13. From the evaluation result, it is understood that the difference in the secondary natural frequency ($CF_2$) of the core caused the difference in the hit sound, even if the primary natural frequency ($CF_1$) of the core and the primary natural frequency ($BF_1$) of the entire golf ball respectively were the same each other. When the secondary natural frequency ($CF_2$) of the core was less than 900 Hz, the golf ball produced too low hit sound which gave the golf player the impression as if the flight distance were short. Such a golf ball was not favored by the golf player. Contrary to this, when the secondary natural frequency ($CF_2$) of the core was higher than 2500 Hz, the golf ball produced very high sound like a metallic sound. Such a golf ball was not favored by the golf player.

According to the present invention, the ratio between the primary natural frequency ($CF_1$) of the core and the primary natural frequency ($BF_1$) of the entire golf ball is controlled to satisfy the relationship of $0.3 \leqq CF_1/BF_1 \leqq 0.78$. With this arrangement, the golf ball has an advantage of giving mild impact to the golf player while producing a long flight distance.

Furthermore, when the secondary natural frequency ($CF_2$) of the core is controlled to fall within the range between 850 to 2700 Hz, the golf ball produces an excellent hit sound which gives a good impression to the golf player.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A golf ball comprising:

a core and a cover that covers the core, wherein a ratio between the primary natural frequency ($CF_1$) of the core and the primary natural frequency ($BF_1$) of the golf ball satisfies the following mathematical relation:

$$0.30 \leqq CF_1/BF_1 \leqq 0.78.$$

2. The golf ball according to claim 1, wherein the primary natural frequency ($BF_1$) of the golf ball is 550 to 1700 Hz.

3. The golf ball according to claim 2, wherein the secondary natural frequency ($CF_2$) of the core of the golf ball is 850 to 2700 Hz.

4. The golf ball according to claim 1, wherein the primary natural frequency ($BF_1$) of the golf ball is 800 to 1400 Hz, and the primary natural frequency ($CF_1$) of the core is 400 to 850 Hz.

5. The golf ball according to claim 1, wherein the secondary natural frequency ($CF_2$) of the core of the golf ball is 850 to 2700 Hz.

6. The golf ball according to claim 5, wherein the primary natural frequency ($BF_1$) of the golf ball is 550 to 1700 Hz.

7. The golf ball according to claim 6, wherein the secondary natural frequency ($CF_2$) of the core of the golf ball is 850 to 2700 Hz.

8. The golf ball according to claim 5, wherein the primary natural frequency ($BF_1$) of the golf ball is 800 to 1400 Hz, and the primary natural frequency (CF1) of the core is 400 to 850 Hz.

9. The golf ball according to claim 5, wherein the secondary natural frequency ($CF_2$) of the core of the golf ball is 850 to 2700 Hz.

10. A golf ball comprising:

a core and a cover that covers the core;

(a) said core has a diameter of about 32.7 to 40.7 mm;

(b) said core comprising:

(b1) 100 parts by weight vulcanized rubber composition, wherein said composition contains 80 weight % or more of polybutadiene rubber having at least 80 weight % of cis-1,4 bond, (b2) 25 to 45 parts by weight per 100 parts by weight of said vulcanized rubber of a metal salt of an unsaturated carboxylic acid, (b3) 0.5 to 30 parts by weight per 100 parts by weight of said vulcanized rubber of an organic peroxide, and (b4) a specific gravity adjusting agent;

(c) said cover having a thickness in the range of 1 to 5 mm; and (d) said cover comprising:

a composition containing an ionomer resin or a mixture of an ionomer resin and a thermoplastic resin, wherein a ratio between the primary natural frequency ($CF_1$) of the core and the primary natural frequency ($BF_1$) of the golf ball satisfies the following mathematical relation:

$$0.30 \leqq CF_1/BF_1 \leqq 0.78.$$

11. The golf ball according to claim 10, wherein said golf ball is a two-piece golf ball consisting essentially of a single-layered core and a single-layered cover.

12. A method for making a golf ball, comprising the steps of:

(a) obtaining a core having a diameter of about 32.7 to 40.7 mm, said core comprising:

(i) 100 parts by weight of a vulcanized rubber composition, wherein said composition contains 80 weight % or more of polybutadiene rubber having at least 80 weight % of cis-1,4 bonds.

(ii) 25 to 45 parts by weight per 100 parts by weight of said vulcanized rubber of a metal salt of an unsaturated carboxylic acid, (iii) 0.5 to 30 parts by weight per 100 parts by weight of said vulcanized rubber of an organic peroxide, and (iv) a specific gravity adjusting agent;

(b) forming a cover on said core with a cover composition having a thickness in the range of 1 to 5 mm, said cover composition comprising:

an ionomer resin or a mixture of an ionomer resin and a thermoplastic resin; and (c) selecting said core and said cover that comprise the golf ball, so that the ratio between the primary natural frequency ($CF_1$) of the core and the primary natural frequency ($BF_1$) of the golf ball satisfies the following mathematical relation:

$$0.30 \leqq CF_1/BF_1 \leqq 0.78.$$

13. The method according to claim 12, further comprising the step of:

(d) selecting said core and said cover that comprises the golf ball, wherein the secondary natural frequency ($CF_2$) of the core of the golf ball is 850 to 2700 Hz.

* * * * *